US007066825B1

(12) United States Patent
Moussa

(10) Patent No.: US 7,066,825 B1
(45) Date of Patent: Jun. 27, 2006

(54) GOLF SWING TRAINING AID AND METHOD OF USE OF THE SAME

(75) Inventor: Jesse Moussa, Camrose (CA)

(73) Assignee: Inside Touch Inc., Edmonton (CA)

( * ) Notice: Subject to any disclaimer, the term of this patent is extended or adjusted under 35 U.S.C. 154(b) by 0 days.

(21) Appl. No.: 11/031,907

(22) Filed: Jan. 7, 2005

(51) Int. Cl.
*A63B 69/36* (2006.01)

(52) U.S. Cl. ..... 473/215; 473/207; 473/216; 473/266

(58) Field of Classification Search ..... 473/207–216, 473/266–277; D21/791; 446/28; 273/DIG. 19, 273/DIG. 30
See application file for complete search history.

(56) References Cited

U.S. PATENT DOCUMENTS

| | | | | | |
|---|---|---|---|---|---|
| 2,103,502 | A | * | 12/1937 | Webster | 473/215 |
| 4,479,653 | A | * | 10/1984 | Woodson | 473/215 |
| 5,390,929 | A | | 2/1995 | Todaro | |
| 5,443,266 | A | | 8/1995 | Bursi | |
| 5,582,551 | A | | 12/1996 | Bursi | |
| D404,103 | S | * | 1/1999 | Winters | D21/791 |
| 5,879,240 | A | | 3/1999 | Stuart | |

* cited by examiner

*Primary Examiner*—Nini F. Legesse
(74) *Attorney, Agent, or Firm*—Davis & Bujold, P.L.L.C.

(57) ABSTRACT

An apparatus includes a body adapted for attachment to a waist of a golfer. A wand-form pointer is secured to the body and has a starting position extending outwardly from the body. The pointer is adapted to encroach into an inside downward swing path of the golfer. The pointer is capable of omni-directional movement, such that it deflects if struck. The pointer is biased to the starting position, such that, when struck, the pointer always returns to the starting position.

5 Claims, 3 Drawing Sheets

GOLF SWING TRAINING AID AND METHOD OF USE OF THE SAME

FIELD OF THE INVENTION

The present invention relates to a golf swing training aid and a method of use of the same.

BACKGROUND OF THE INVENTION

There have been a number of golf swing training aids developed that attach to a golfers body to assist the golfer in developing an inside down swing: U.S. Pat. No. 5,390,929 (Todaro 1995); U.S. Pat. No. 5,443,266 (Bursi 1995); U.S. Pat. No. 5,582,551 (Bursi 1996); and U.S. Pat. No. 5,879,240 (Stuart 1999). Each golf swing training aid attempts to implement an underlying training methodology.

SUMMARY OF THE INVENTION

According to one aspect of the present invention there is provided an apparatus, which includes a body adapted for attachment to a waist of a golfer. A wand-form pointer is secured to the body and has a starting position extending outwardly from the body. The pointer is adapted to encroach into an inside downward swing path of the golfer. The pointer is capable of omni-directional movement, such that it deflects if struck. Means are provided for biasing the pointer back to the starting position, such that, when struck, the pointer always returns to the starting position.

According to another aspect of the present invention there is provided a method. A first step involves providing an apparatus as described above. A second step involves securing the body over a waist of a golfer, with the pointer encroaching into an inside downward swing path of the golfer. A third step involves checking correct positioning of the golfer in preparation for hitting a golf ball toward a target by having the pointer aligned pointed downwardly parallel to a shaft of a golf club and perpendicular to a spine of the golfer. A fourth step involves checking correct positioning of the golfer during the course of swinging by having a forearm of the golfer strike the pointer; the right forearm of a right handed golfer and the left forearm of a left handed golfer. A fifth step involves checking positioning of the golfer upon completion of the swing by having the pointer point toward the target in an orientation which is parallel to an underlying ground surface.

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein.

DETAILED DESCRIPTION OF THE PREFERRED EMBODIMENT

Figure 2:
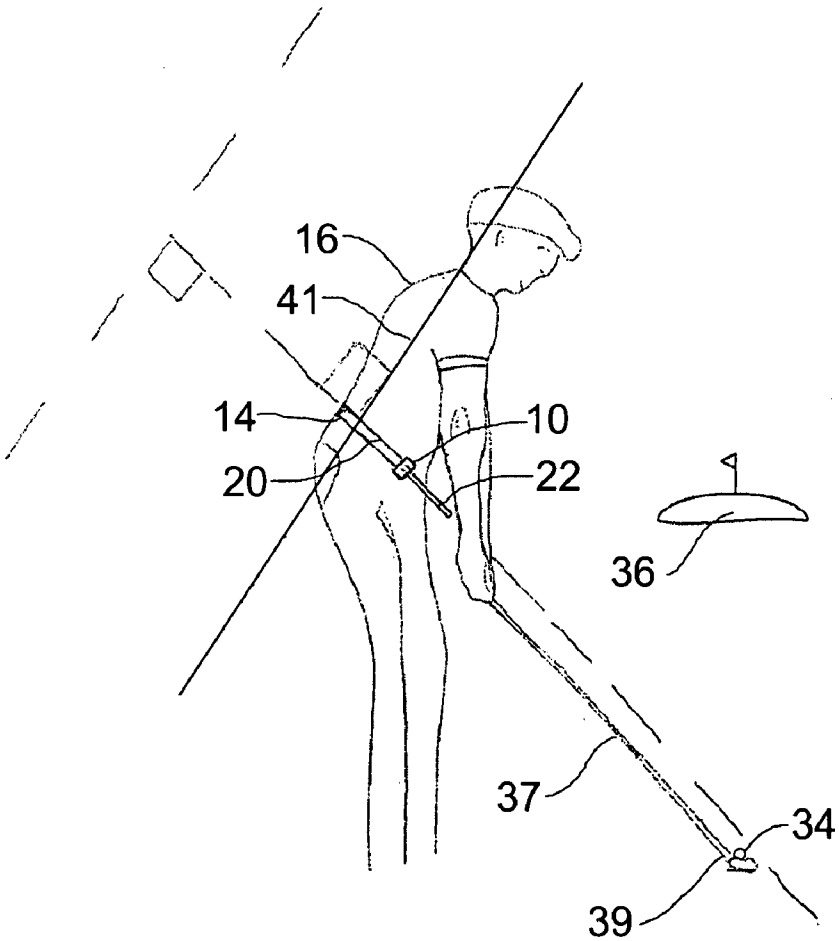
FIG. 2 is a side elevation view of a golfer using the pointer to assume correctly body positioning in relation to a golf ball prior to commencing a backswing portion of his golf swing.

The preferred embodiment, a golf swing training apparatus generally identified by reference numeral 10, will now be described with reference to FIGS. 1 through 5.

Figure 1:
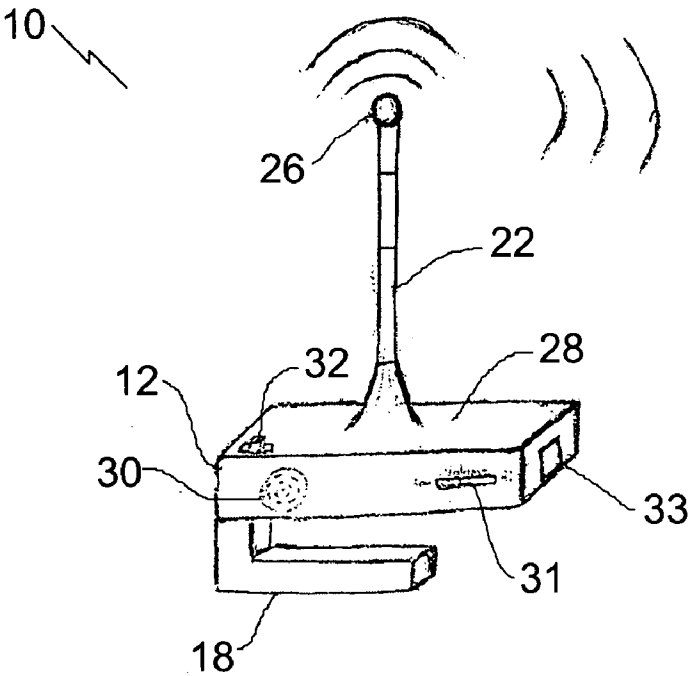
FIG. 1 is a perspective view of a golf swing training apparatus constructed in accordance with the teachings of the present invention.
Figure 4:
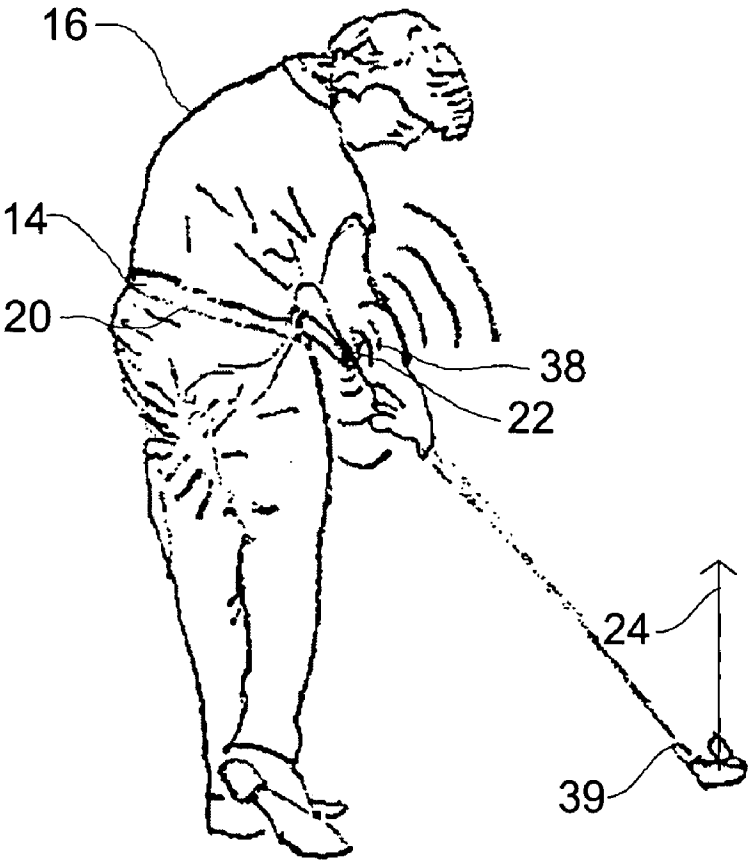
FIG. 4 is a side elevation view of the golfer using the pointer to maintain correct body positioning during the downward position of his golf swing.

Structure and Relationship of Parts:

Referring to FIG. 1, golf training apparatus 10 includes a body 12. Referring to FIGS. 2 through 5, body 12 is intended to be adapted for attachment to a waist 14 of a golfer 16. This can be done in a number of ways. Referring to FIG. 1, in the illustrated embodiment body 12 has a clip 18, which can clip onto a belt 20 worn by golfer 16. A wand-form pointer 22 extends outwardly from body 12. This is considered a starting position for pointer 22 for, as will hereinafter be further described, pointer 22 is capable of omni-directional movement. Referring to FIGS. 3 and 4, when worn, as described, pointer 22 is adapted to encroach into an inside downward swing path, generally indicated by arrow 24, of golfer 16. Pointer 22 is made from a springy resilient material which, In the illustrated embodiment, serves as means for biasing pointer 22 back to the starting position. When struck, pointer 22 always returns to the starting position.

An optional feature, which may be included if desired, is a sensor 26, which is adapted to sense when pointer 22 is struck. An auditory tone generator 28 is coupled to sensor 26. An auditory tone is generated by auditory tone generator 28 and broadcast over speaker 30, whenever sensor 26 sends a signal to auditory tone generator 28 that pointer 22 has been struck. The volume of speaker 30 may be controlled by volume controller 31. A switch 32 is provided to turn this optional feature "on" and "off", by disconnecting power from battery 33, which serves as a power source.

Operation:

The use and operation of golf swing training apparatus 10 will now be described with reference to FIGS. 1 through 5. Referring to FIGS. 2 through 5, body 12 of golf training apparatus is positioned over waist 14 of golfer 16 between hip bone 17 and belly button 19. Referring to FIGS. 3 and 4, when worn, as described, pointer 22 encroaches into an inside downward swing path 24 of golfer 16.

Figure 3:
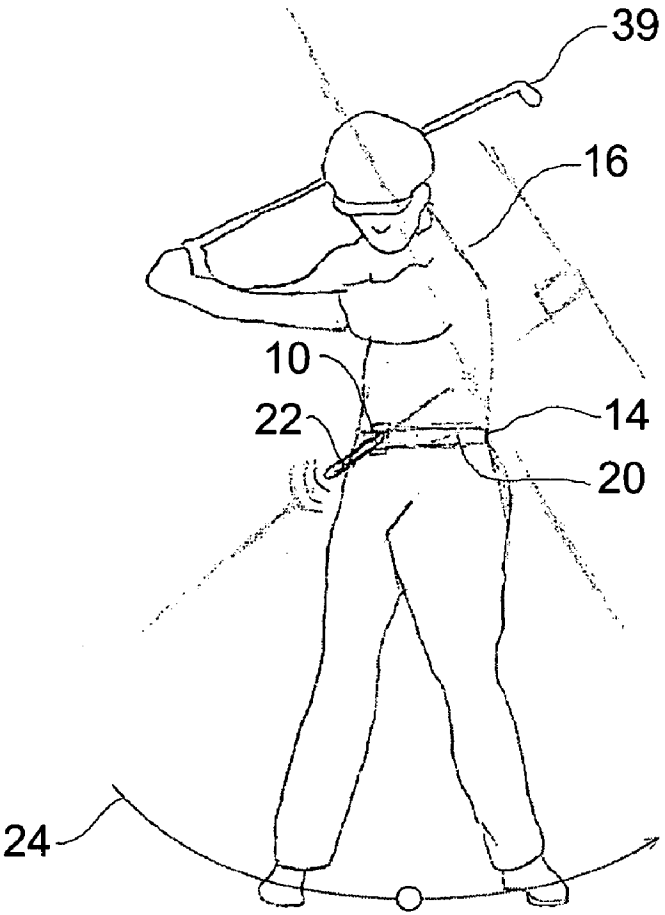
FIG. 3 is a front elevation view of the golfer about to commence a downward portion of his golf swing.

Referring to FIG. 2, it can be seen how golfer 16 can check to ensure he is correctly positioned in preparation for hitting a golf ball 34 toward a target 36. He does this by making sure that pointer 22 is parallel to shaft 37 of golf club 39 and perpendicular to his spine 41. If pointer 22 is not parallel to shaft 37, there is a problem with the spine angle and pelvis tilt of golfer 16. If the pelvis of golfer 16 is tucked under in an incorrect posture, the probe will point up instead of parallel to shaft 37 of golf club 39.

Referring to FIG. 3, on the back swing, pointer 22 can be used to check that the correct hip tilt has been maintained in preparation for a good downswing. Pointer 22 should be pointing down toward the ground just outside the right foot (for right handed golfers) or the left foot (for left handed golfers). If golfer 16 has an improper weight transfer, pointer 22 will point up instead of down toward the ground.

Once at the top of his swing, a golfer is taught to adopt a downward motion of "ringing a bell". Gary Player describes this movement at "pulling a rope from the sky". Referring to FIG. 4, golfer 16 can check to confirm correct positioning of his golf club and arms during the course of his downward swing by having his forearm 38 of strike pointer 22. This will be the right forearm for a right handed golfer and the left forearm for a left handed golfer. Pointer 22 extends into inside downward swing path 24 of golfer 16. If forearm 38 of golfer 16 does not strike pointer 22, golfer 16 is not following an inside downward swing path.

Figure 5:
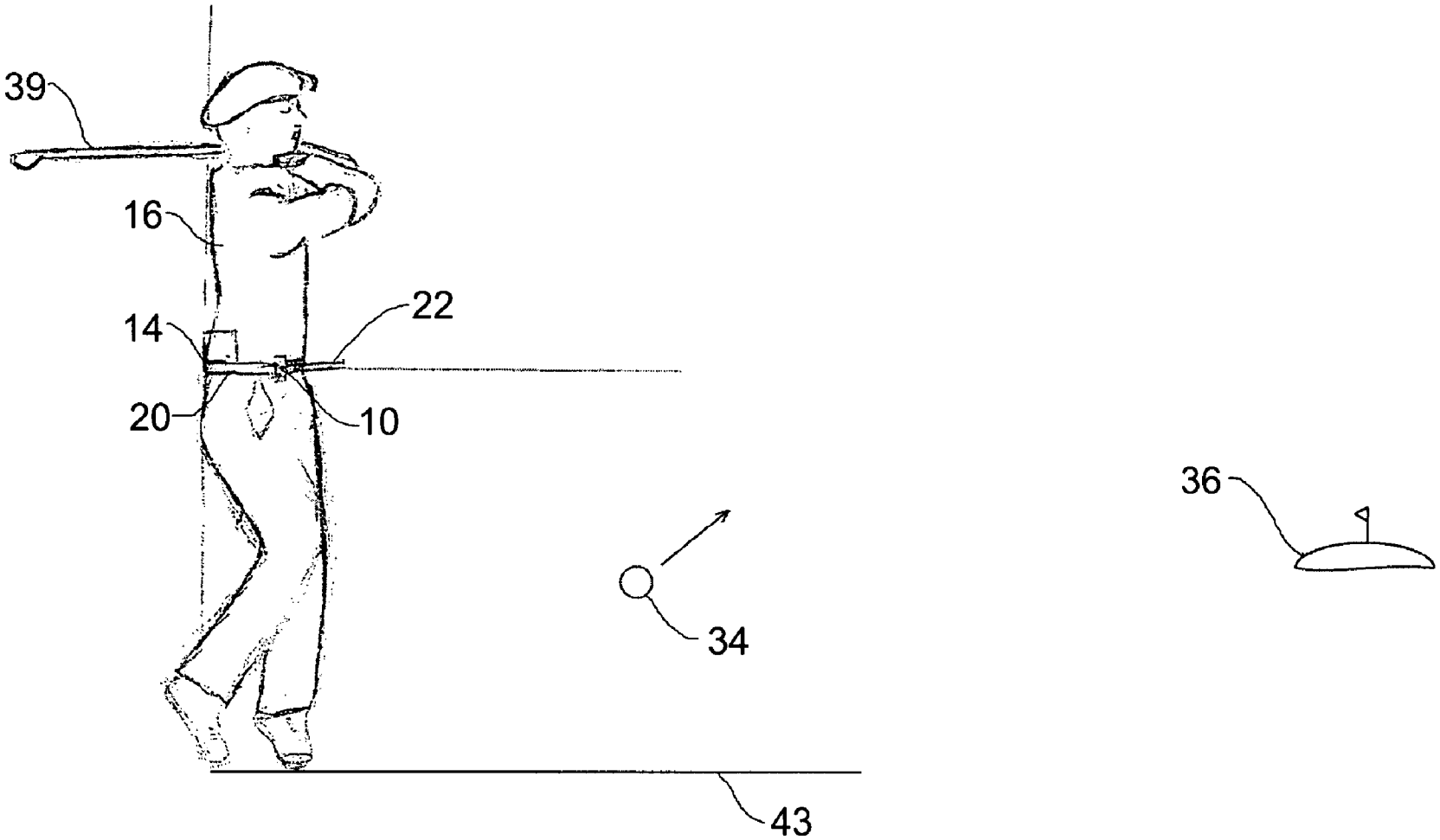
FIG. 5 is a front elevation view of the golfer using the pointer to maintain correct body positioning during the follow through position of his golf swing.

A golfer is taught that, upon completion of his follow through, he should be facing the target. Referring to FIG. 5, upon completion of his swing golfer 16 can check to see if he used a proper follow through by noting whether pointer 22 is pointing toward target 36 parallel to underlying ground surface 43. This positioning is indicative of a complete weight transfer and balanced follow through.

Referring to FIG. 1, if the golfer is of the opinion that an auditory confirmation would be helpful, he can turn switch 32 to the "on" position. This will result in an auditory tone being heard via speaker 30 every time pointer 22 is struck.

The golf training aid, as described above, provides a valuable posture check during set up, during the back swing, during the downward portion of the golf swing and during completion of the follow through. This correct posture ensures that the body is balanced in a strong position to allow optimal room for the correct inside downward swing path of the golfers forearms and club head.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope of the invention as hereinafter defined in the Claims.

What is claimed is:

1. An apparatus, comprising:

a body adapted for attachment to a waist of a golfer; a wand-form pointer having a starting position extending outwardly from a first end fixed to the body and terminating in a second remote free end, which is adapted to encroach into an inside downward swing path of the golfer;

the pointer being capable of omni-directional movement, such that it deflects if struck; and means for biasing the pointer back to the starting position, such that, when struck, the pointer always returns to the starting position.

2. An apparatus, comprising:

a body adapted for attachment to a waist of a golfer: a wand-form pointer having a starting position extending outwardly from the body, which is adapted to encroach into an inside downward swing path of the golfer;

the pointer being capable of omni-directional movement, such that the pointer deflects if struck; and means for being the pointer back to the starting position, such that, when struck the pointer always returns to the starting position; and a sensor being provided which is adapted to sense when the pointer is struck, and an auditory tone generator being coupled to the sensor, such that an auditory tone is generated whenever the pointer is struck.

3. The apparatus as defined in claim 2, wherein the pointer is made from a springy resilient material which serves as the means for biasing the pointer back to the starting position.

4. A method, comprising the steps of:

providing a golf training aid, comprising:

a body;

a wand-form pointer having a starting position extending outwardly from the body, the pointer being capable of omni-directional movement, such that it deflects if struck; and means for biasing the pointer back to the starting position, such that, when struck, the pointer always returns to its starting position;

securing the body over a waist of a golfer, with the pointer encroaching into an inside downward swing path of the golfer;

checking correct positioning of the golfer in preparation for hitting a golf ball toward a target by having the pointer aligned to point downwardly parallel with a shaft of a golf club;

checking correct positioning of the golfer during the course of swinging by having a forearm of the golfer strike the pointer, the forearm being a right forearm for a right handed golfer and a left forearm for a left handed golfer; and checking positioning of the golfer upon completion of the swing by having the pointer point toward the target in an orientation which is parallel to an underlying ground surface.

5. The method as defined in claim 4, including a step of checking hip rotation of the golfer during a back swing by maintaining the probe downwardly angled during the back swing.

* * * * *